US005290159A

United States Patent [19]

Miller et al.

[11] Patent Number: 5,290,159

[45] Date of Patent: Mar. 1, 1994

[54] DOWNHOLE PUMP OF CONSTANT DIFFERENTIAL HYDRAULIC PRESSURE

[75] Inventors: Mark A. Miller, Houston; James D. Fox, Stafford, both of Tex.

[73] Assignee: Exxon Production Research Company, Houston, Tex.

[21] Appl. No.: 3,073

[22] Filed: Mar. 4, 1993

[51] Int. Cl.[5] ..... F04B 23/04

[52] U.S. Cl. ..... 417/521

[58] Field of Search ..... 417/521, 107, 244, 265, 417/419, 540

[56] References Cited

U.S. PATENT DOCUMENTS

| | | | |
|---|---|---|---|
| 753,530 | 3/1904 | Ten Eyck . | |
| 1,969,920 | 8/1934 | Andrews | 221/47.3 |
| 2,023,771 | 12/1935 | Ringius | 103/37 |
| 2,434,296 | 1/1948 | Swanson | 103/37 |
| 3,101,873 | 8/1963 | Hunt | 222/252 |
| 3,665,808 | 5/1972 | Vestal | 91/272 |
| 3,777,814 | 12/1973 | Gustavson et al. | 166/212 |
| 4,173,437 | 11/1979 | Leka et al. | 417/521 |
| 4,457,367 | 7/1984 | Brandell | 166/105 |
| 4,568,250 | 2/1986 | Falk et al. | 417/254 |
| 4,664,186 | 5/1987 | Roeder | 166/68.5 |
| 5,017,105 | 5/1991 | Röttel | 417/521 |

FOREIGN PATENT DOCUMENTS

| | | | |
|---|---|---|---|
| 2469578 | 5/1981 | France | 9/14 |
| 181586 | 11/1965 | U.S.S.R. | 355/61 |

*Primary Examiner*—Richard A. Bertsch
*Assistant Examiner*—Alfred Basichas
*Attorney, Agent, or Firm*—Susan A. McLean

[57] ABSTRACT

A combination low-pressure, high-pressure hydraulic pump which allows a constant differntial pressure is disclosed. This pump features dual concentric pistons, each with its own chamber. The pistons reciprocate together at low pressures; as the system pressure increases, a spring resists the stroke of the low pressure piston, so that ultimately only the smaller, high pressure piston reciprocates.

7 Claims, 2 Drawing Sheets

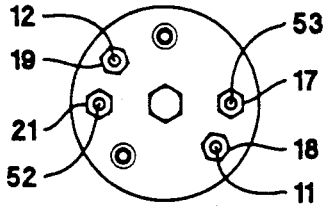
FIG. 2B
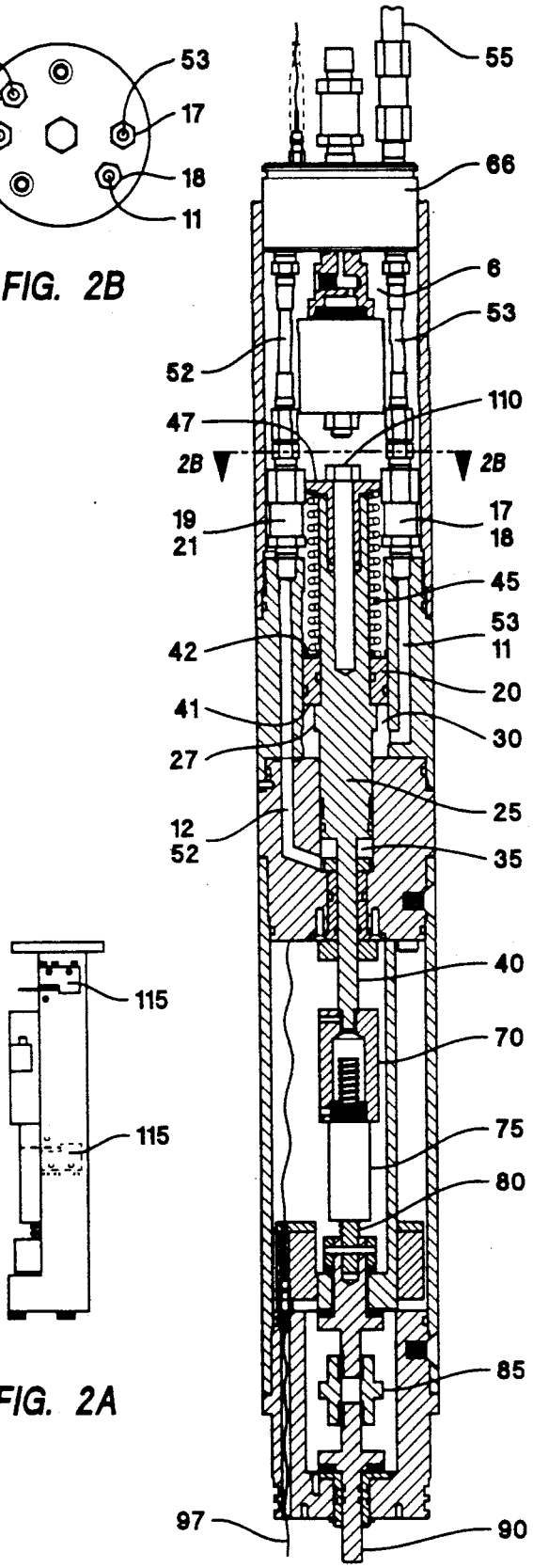
FIG. 2
FIG. 2A
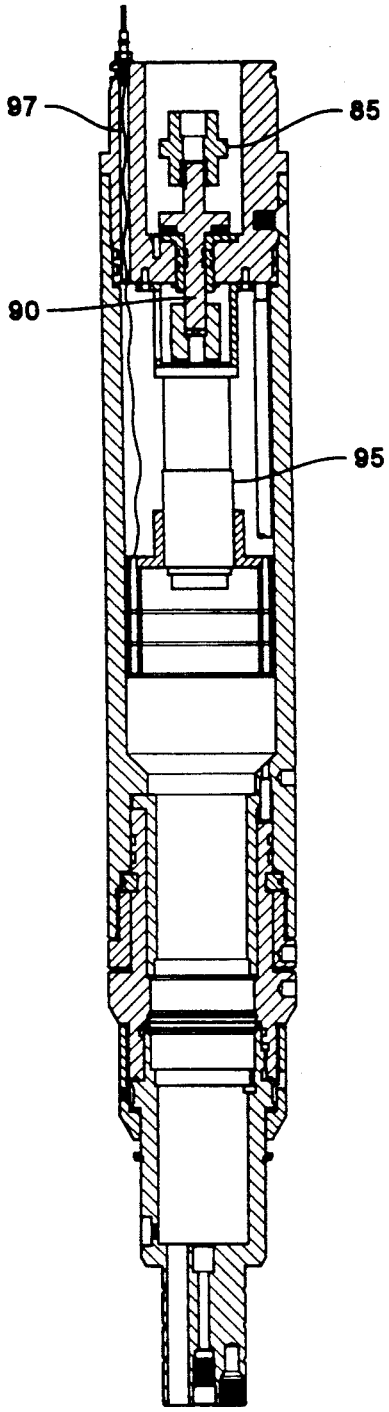
FIG. 3

DOWNHOLE PUMP OF CONSTANT DIFFERENTIAL HYDRAULIC PRESSURE

FIELD OF INVENTION

This invention generally relates to a hydraulic pump which creates a constant hydraulic pressure differential over the hydrostatic pressure. This pump is useful for operating downhole tools, but is not limited to that application.

BACKGROUND OF INVENTION

In the field of geophysical exploration, particularly seismic exploration, it has been found useful to place equipment deep into boreholes (well below the earth's surface) for a variety of reasons, such as measuring seismic energy, micro earthquake recording, determination of fracture orientation or geometry in oil well hydrofracturing, etc.

For example, seismic receivers, or geophones, may be lowered downhole to measure the seismic signals created from explosive shots on the surface or, in the case of crosshole technology, deep within a nearby wellbore.

A typical tool of the relevant art includes the following elements in a single housing: sensors, such as geophones, that convert mechanical vibrations into electric signals; associated electronics; a clamp that wedges the tool against the borehole wall; and a motor that actuates the clamp.

During acquisition of seismic data, the detector is lowered into a borehole, which borehole is generally filled with a fluid such as water, oil, drilling fluid or fracturing gellant. It is then clamped at a desired depth. Seismic waves are created by conventional sources and detected by the tool. The tool is then placed at a different depth, and the process repeated. In the most common configuration, data can be recorded by only one detector unit at one depth at a time. Recently, multiple downhole tools have been introduced to obviate repeated relocation of a single tool.

Many of these single downhole logging and seismic tools contain apparatus which creates a constant hydraulic pressure differential relative to hydrostatic borehole pressure. This means that the amount of pressure in the hydraulic system is always a certain set amount over the hydrostatic borehole pressure, which borehole pressure varies with the depth at which the downhole pump is operating. Typically, this hydraulic pressure is used to operate a clamp, usually on an "arm," to secure the tool to the wall of the borehole. Generally, pressures of 200 to 500 psi above the varying hydrostatic pressure are needed to provide sufficient force for a firm clamp.

One type of downhole tool that uses a hydraulic pressure generating apparatus is a wall locking geophone as described in the patent to Gustavson et al (U.S. Pat. No. 3,777,814). This pump consists of a dual hydraulic system to protect the delicate components of the pump from the pressure of the borehole fluid. The first hydraulic system includes an electric motor connected to a piston, both of which are located in a pressure-tight bay, and a second piston in a chamber exposed to borehole pressure. The second hydraulic system includes a third piston which is mechanically coupled to the second piston in the first hydraulic system and which generates the differential hydraulic pressure to clamp one geophone assembly to the borehole wall. Such hydraulic systems are typical in the art.

Additional problems are presented, however, when the downhole hydraulic pump is required to service multiple downhole tools. An example of this case is presented in U.S. patent application 07/652,333, wherein multiple downhole geophones are used simultaneously. The hydraulic pumps of the related art can supply the pressure to clamp a single unit, but cannot sufficiently pressurize the large volume of hydraulic fluid required to clamp multiple units. To adapt the downhole pump of Gustavson to this service would require the use of unfeasibly long pistons.

SUMMARY OF THE INVENTION

The downhole pump of this invention will supply constant hydraulic pressures above hydrostatic pressure to operate one tool or a plurality of tools. The present invention includes a flexible bladder assembly to provide a hydraulic reference to borehole pressure. A dual hydraulic system as described by Gustavson is not required. In addition, the present invention can supply both positive and negative (suction) pressures.

An electronically-controlled motor turns a ball-screw that drives a two-stroke dual piston. The dual piston consists of an inner and outer piston. At the outset of operation, i.e., at low pressures, these two pistons operate in tandem. The larger outer piston pumps a large volume of hydraulic fluid at lower pressures. As the differential pressure increases, the outer piston will slow down and gradually cease to move due to a spring which, in combination with the system differential pressure, limits the travel of the outer piston. The smaller inner piston then moves within the smaller piston's associated chamber to achieve the rated pressure for the system. The pressure at which the large outer piston gradually ceases stroking is a function of the spring constant, and thus can be varied by changing springs.

In its best mode, the pump operates with only two wires (power in and return) connecting it to the surface. Limit switches trigger the electronics to reverse the motor at the end of each stroke of the piston. The pump automatically shuts off after achieving the desired pressure. Check valves and solenoid valves are used to control the generation of positive or negative pressures.

BRIEF DESCRIPTION OF THE DRAWINGS

FIG. 2 depicts the dual piston section of the apparatus, which section actually does the pumping.

FIG. 2A shows the portion of the pump containing limit switches, which operate to restrict the stroke of the pump, reversing the motor direction when triggered.

FIG. 2B depicts the cross-section of the pump at the inlet and outlet area.

FIG. 3 depicts the motor, or bottommost, section of the pump.

DETAILED DESCRIPTION OF THE INVENTION

Figure 1:
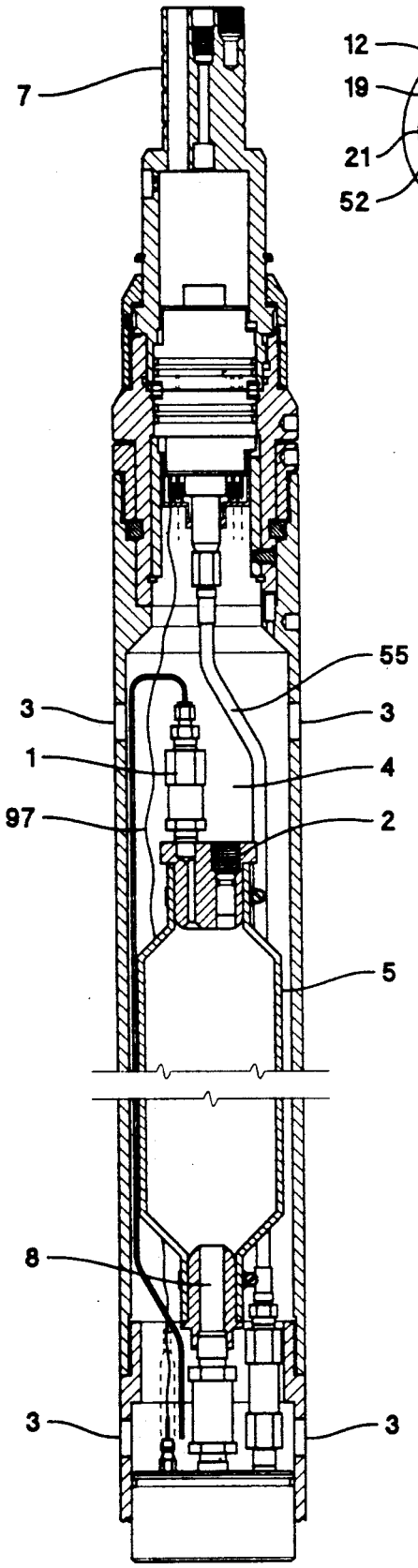
FIG. 1 depicts the bladder, or topmost section, of the pump of this invention.
Figure 1B:
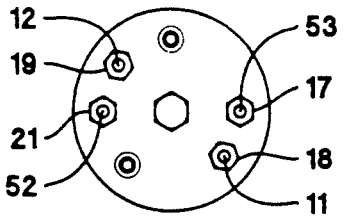
FIG. 1B depicts the cross-section of the pump at the inlet and outlet area.

In FIG. 1, bladder 5 and the hydraulic system are filled with hydraulic fluid through fill nozzle 2. Check valve 1 opens to allow the escape of air from the hydraulic system while filling, then closes to close the hydraulic system. The pump is then connected to other downhole apparatus via connector 7 on FIG. 1. The entire assembly of pump and other downhole apparatus is then lowered into a borehole. The motor 9$ in FIG. 3 is started by energizing wire 97. The motor 95 then turns shaft 90 which is coupled in FIG. 2 via couple 85 to ball screw 80 and ball screw socket 75, which translate the rotary energy of the motor into a reciprocating motion. The travel of the ball screw 80 is limited by limit switches 115 which, when activated, reverse the direction of the motor 95. The ball screw socket is connected to pump shaft 40 via coupler 70, which is connected in FIG. 2 to inner (high pressure) piston 25. Piston 25 reciprocates within chamber 35, and is slidably connected to a concentric outer (low pressure) piston 20, which reciprocates within chamber 30. At low pressures, piston 20 is secured in place relative to piston 25 by a spring 45 pressing against surface 42 of piston 20, and piston stop 27 of piston 25 pressing against surface 41 of piston 30. Spring 45 is compressed against spring stop 47, which is secured to piston 25 by screw 110. At lower pressures, spring 45 presses against surface 42 of piston 20, so that piston 25 and piston 20 travel together. However, as the hydraulic system pressure increases to offset the spring constant of spring 45, the travel of piston 20 will slow down and gradually cease and piston 25 will first travel not in unison with piston 20 and ultimately travel alone.

Ports 3 in the bladder section shown in FIG. 1 allow the intrusion into the bladder chamber 4 of downhole fluid. This intrusion provides a reference pressure for the differential pressure delivered by the pump.

Due to the pumping action of piston 20 and piston 25 in FIG. 4, hydraulic fluid leaves bladder 5 of FIG. 1 through bladder outlet s. It enters and fills the cavity 6 of the section shown in FIG. 2. The hydraulic fluid passes into the pump intake line 11 through check valve 18 to chamber 30 and into pump intake line 12 through check valve 19 to chamber 35. Check valves 18 and 19 allow flow only into their respective chambers 30 and 35 via the respective pump inlets 11 and 12. The pumping action of piston 20 and of piston 25 forces the hydraulic fluid out of chambers 30 and 35 through their respective discharge lines 53 and 52 and check valves 17 and 21. At high pressures, piston 20 gradually ceases to move and hydraulic fluid flows only through inlet path 12 and check valve 19 into chamber 35, where it is forced by the reciprocating action of piston 25 out the discharge line 52 and check valve 21.

Discharge lines 52 and 53 combine into discharge line 55 via discharge manifold 66 in FIG. 2. The discharge line 55 could then be routed directly to the hydraulic systems of the associated downhole equipment.

Figure 1A:
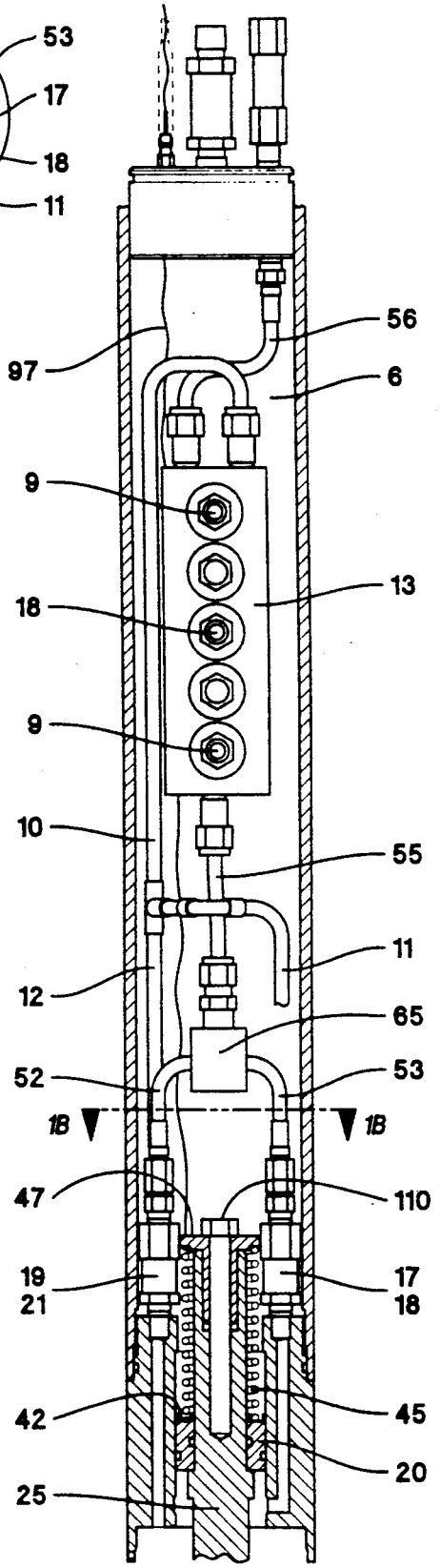
FIG. 1A depicts the optional manifold section of the best mode.

Alternatively, the manifold of FIG. 1A may be inserted into the pump between the bladder section of FIG. 1 and the pump section of FIG. 2. This optional manifold section is useful particularly where it is desirable to have the pump draw a suction relative to the reference (borehole) pressure. When this manifold section is used, the hydraulic fluid is routed to the cavity 6 of the manifold section, and then through a five valve manifold 13 which allows switching of inlets and outlets so that the pump may use the pump discharge 56 as the inlet line and the bladder outlet 8 as the discharge point, allowing the hydraulic systems of the associated apparatus or apparatus to be drained, or alternatively allowing the pump to be operated as a suction device. In normal operation, hydraulic fluid enters the manifold 13 from cavity 6 through ports 9. Manifold 13 routes the hydraulic fluid to inlet line 10, which then routes the oil to pump inlet paths 11 and 12 through check valves 18 and 19 respectively, and then to chambers 30 and 35 respectively. Upon leaving the pump chambers, the fluid passes from chambers 30 and 35 through check valves 17 and 21 respectively on outlet lines 53 and 52 respectively. Outlet lines 53 and 52 combine in FIG. 1A in tee 65, which then routes the hydraulic fluid through line 55 to manifold 13. Port 18 on manifold 13 is a dump valve, used to depressure the system. Under normal operation, the hydraulic fluid outlet is routed through manifold 13, which then routes the fluid out of the pump via pump outlet line 56.

While the pump of this invention was designed to address the needs in the area of geophysical exploration, particularly in the use of multiple downhole devices, it is not limited to this application. This pump can be used in other application wherein a combination low pressure/high pressure hydraulic pump is used, such as, without limitation, a car jack or a hydraulic lift for automobiles. Other uses of this invention will be apparent to one skilled in the art from the specification and claims herein.

What is claimed is:

1. A combination low pressure and high pressure hydraulic pump comprising:
   (a) a housing defining a longitudinal bore, which bore has a first chamber larger in diameter than a second chamber, and which first chamber and second chamber each contains an inlet and an outlet;
   (b) a cylindrical first piston sealingly mounted in said housing and adapted for reciprocating movement within the first chamber, which first piston defines a second longitudinal bore with essentially the same diameter as the second chamber;
   (c) a second piston sealingly mounted in said second longitudinal bore and adapted for reciprocating movement within said second longitudinal bore and said second chamber;
   (d) a spring to couple the first piston and the second piston at lower pressures, which lower pressures depend upon the spring constant of the spring;
   (e) means for reciprocating said pistons in said chambers; and
   (f) a connecting rod connecting said second piston to said reciprocating means.

2. The apparatus of claim 1, wherein said spring for coupling the first piston to the second piston at lower pressures can be adjusted or replaced so as to vary the pressure at which the stroke of said first piston slows and ultimately ceases.

3. The apparatus of claim 1, wherein each of the two said inlets has a means allowing flow into, but not out of, its respective chamber, and each of the two said outlets has a means allowing flow out of, but not into, its respective chamber.

4. The apparatus of claim 1 wherein said reciprocating means ceases stroking when the hydraulic system achieves a preselected pressure.

5. The use of the apparatus of claim 1 to supply a constant differential hydraulic pressure to downhole geophysical equipment.

6. The use of the apparatus of claim 2 to supply a constant differential hydraulic pressure to downhole geophysical equipment.

7. The use of the apparatus of claim 3 to supply a constant differential hydraulic pressure to downhole geophysical equipment.

* * * * *